US008389192B2

(12) United States Patent
Kiyono et al.

(10) Patent No.: US 8,389,192 B2
(45) Date of Patent: Mar. 5, 2013

(54) ELECTROPHOTOGRAPHIC CARRIER, ELECTROPHOTOGRAPHIC DEVELOPER, PROCESS CARTRIDGE AND IMAGE FORMING DEVICE

(75) Inventors: Fusako Kiyono, Kanagawa (JP); Takeshi Shoji, Kanagawa (JP); Yosuke Tsurumi, Kanagawa (JP); Akihiro Iizuka, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 411 days.

(21) Appl. No.: 12/726,617

(22) Filed: Mar. 18, 2010

(65) Prior Publication Data

US 2011/0020747 A1 Jan. 27, 2011

(30) Foreign Application Priority Data

Jul. 22, 2009 (JP) ..... 2009-171422

(51) Int. Cl.
*G03G 9/00* (2006.01)

(52) U.S. Cl. ..... 430/111.35; 399/252

(58) Field of Classification Search ..... 430/111.35; 399/252
See application file for complete search history.

(56) References Cited

U.S. PATENT DOCUMENTS

| | | | | |
|---|---|---|---|---|
| 5,631,116 | A | 5/1997 | Uchida et al. | |
| 6,132,917 | A * | 10/2000 | Hoffend et al. | 430/111.33 |
| 2009/0111042 | A1 | 4/2009 | Kiyono et al. | |

FOREIGN PATENT DOCUMENTS

| | | |
|---|---|---|
| JP | A 7-114219 | 5/1995 |
| JP | A 2009-10407 | 1/2009 |
| JP | A 2009-109701 | 5/2009 |

* cited by examiner

*Primary Examiner* — Mark A Chapman
(74) *Attorney, Agent, or Firm* — Oliff & Berridge, PLC

(57) ABSTRACT

An electrophotographic carrier includes a magnetic core material and a resin layer that coats the magnetic core material, the resin layer comprising a resistance control agent and a polymer including a repeating unit derived from an alicyclic group-containing methacrylic ester, the resin layer including a monomer as a base material of the repeating unit in the polymer in an amount of from about 0.5% by weight to about 3.0% by weight relative to the total amount of the resin layer.

15 Claims, 2 Drawing Sheets

ELECTROPHOTOGRAPHIC CARRIER, ELECTROPHOTOGRAPHIC DEVELOPER, PROCESS CARTRIDGE AND IMAGE FORMING DEVICE

CROSS-REFERENCE TO RELATED APPLICATION

This application is based on and claims priority under 35 USC 119 from Japanese Patent Application No. 2009-171422 filed on Jul. 22, 2009.

BACKGROUND

1. Technical Field

The present invention relates to an electrophotographic carrier, an electrophotographic developer, a process cartridge and an image forming apparatus.

2. Related Art

In recent years, there have been demands for copiers or printers to be reduced in size or to run at high speed. Further, from the viewpoint of reduction of maintenance costs, there have been increasing demands for developers to have longer life.

Since it is necessary to improve the load in a developing device, in particular, the load on a toner, in order to increase the life of a developer and the durability of a carrier, numerous studies have been conducted regarding these issues.

SUMMARY

According to an exemplary embodiment of the invention, there is provided an electrophotographic carrier including a magnetic core material and a resin layer that coats the magnetic core material, the resin layer containing a resistance control agent and a polymer including a repeating unit derived from an alicyclic group-containing methacrylic ester, the resin layer including a monomer as a base material of the repeating unit in the polymer in an amount of from 0.5% by weight to 3.0% by weight (or from about 0.5% by weight to about 3.0% by weigh) relative to the total amount of the resin layer.

BRIEF DESCRIPTION OF THE DRAWINGS

Exemplary embodiments of the present invention will be described in detail based on the following figures, wherein.

DETAILED DESCRIPTION

Figure 1:
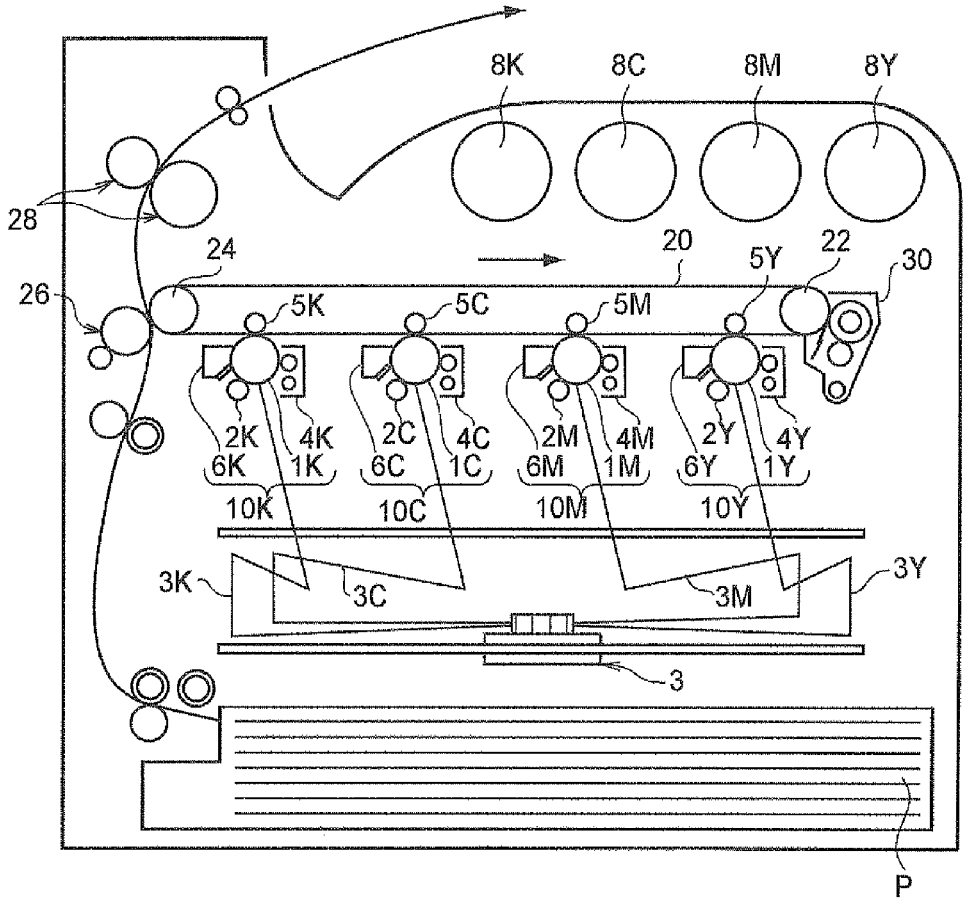
FIG. 1 is a schematic configuration diagram showing an example of an image forming apparatus according to the present exemplary embodiment.

Hereinafter, the exemplary embodiment of the electrophotographic carrier, the electrophotographic developer, the process cartridge, and the image forming apparatus of the invention is described in detail.

Electrophotographic Carrier

The electrophotographic carrier according to the present exemplary embodiment is an electrophotographic carrier including a magnetic core material and a resin layer that coats the magnetic core material, the resin layer containing a resistance control agent and a polymer including a repeating unit derived from an alicyclic group-containing methacrylic ester, the resin layer including a monomer as a base material of the repeating unit in the polymer in an amount of from 0.5% by weight to 3.0% by weight (or from about 0.5% by weight to about 3.0% by weight) relative to the total amount of the resin layer.

The colonization of printing using an electrophotographic image forming apparatus has come into widespread use. In general, there is a large degree of variation of the image densities of color images, and when low density images are continuously output, the toner properties in the developing device deteriorate. In general, deteriorated toner is more easily developed than fresh toner due to the difference in chargeability (a deteriorated toner usually having lower chargeability). On the other hand, in a high humidity environment (for example, at a relative humidity of 80%), a non-electrostatic adhesion force such as a liquid crosslinking force is stronger in deteriorated toner than in fresh toner, as a result of which fresh toner is developed more easily. In particular, when a carrier having a resin layer that includes a coating resin with high hydrophobicity and in which materials such as a resistance control agent have been dispersed is used, the adhesion force of the toner increases in the area including the dispersed materials and, as a result, the intended effect of the dispersed materials cannot be attained and, further, selective development of the toner occurs. As a result, there may be some cases where the deteriorated toner becomes further deteriorated or where, when output of a high image density is demanded, the required density cannot be acquired even with a wider development potential.

In the present exemplary embodiment, a polymer including a repeating unit derived from an alicyclic group-containing methacrylic ester is used as the coating resin of a carrier and, further, the content of the monomer that is a base material of the repeating unit in the polymer is adjusted to within a specific range.

It is thought that the adhesion force distribution is caused by a difference in the liquid crosslinking force between the dispersed materials and the resin. That is, when a resin having high hydrophobicity is used, the liquid crosslinking force becomes weaker in the area including the resin, while the liquid crosslinking force becomes stronger in the area including the dispersed materials, thereby causing uneven distribution of the adhesion force. When the resin layer contains the monomer as a base material of the repeating unit in the polymer, the difference in the adhesion forces between the dispersed materials and the resin may be reduced due to the weak polarity of the monomer, and the required hydrophobicity may be ensured. As a result, uneven distribution of adhesion force may be reduced.

Since a polymer including a repeating unit derived from an alicyclic group-containing methacrylic ester has high hydrophobicity, a carrier having a resin layer containing the polymer may exhibit stable resistance and chargeability. Further, when the resin layer contains the monomer as a base material of the repeating unit in the polymer in a specific amount, uneven distribution of adhesion force between the toner and carrier may be reduced. When the content of the monomer as a base material of the repeating unit is 0.5% by weight or more, uneven distribution of the adhesion force may be suppressed. When the content of the monomer as the base material of the repeating unit is 3.0% by weight or less, reduction in the hydrophobicity of the polymer including the repeating unit derived from an alicyclic group-containing methacrylic ester may be suppressed.

In the present exemplary embodiment, the content of the monomer as a base material of the repeating unit in the polymer in the resin layer refers to a value as measured by the following method.

1 g of a sample is precisely weighted, 0.02 g of isobutyl alcohol as an internal standard material is added thereto precisely, and then 15 ml of dichloromethane is added thereto and mixed, thereby obtaining a sample solution. 1 μL of a monomer standard liquid which is separately prepared and the obtained sample solution are used to measure the peak areas of the monomer and the internal standard material using a gas chromatography method, and the content of the monomer is determined by an internal standard method.

Hereinafter, each component constituting the electrophotographic carrier according to the present exemplary embodiment is described in detail.

The electrophotographic carrier according to the present exemplary embodiment includes a magnetic core material and a resin layer that coats the magnetic core material, and the resin layer contains the resistance control agent and the polymer including a repeating unit derived from an alicyclic group-containing methacrylic ester.

The magnetic core material used in the present exemplary embodiment is not particularly limited, but examples thereof include magnetic metals such as iron, steel, nickel, or cobalt, magnetic oxides such as ferrite or magnetite, and core materials having magnetic particles dispersed therein, which contain magnetic particles and a binder resin.

Preferable examples of the ferrite include those having a structure represented by the following Formula (1).

$$(MO)_X(Fe_2O_3)_Y \qquad \text{Formula (1)}$$

In Formula (1), M represents at least one selected from the group consisting of Cu, Zn, Fe, Mg, Mn, Ca, Li, Ti, Ni, Sn, Sr, Al, Ba, Co, and Mo; and X and Y each independently represent a molar ratio, wherein X+Y=100.

Here, the core material having magnetic particles dispersed therein is one in which magnetic particles are dispersed in a binder resin.

Any one of conventionally known ones may be used as the magnetic particle. Among these, ferrite, magnetite, and maghemite are preferably used. In particular, as the ferromagnetic magnetic particle, magnetite or maghemite is preferably used. Examples of the magnetic particles further include iron powder. Iron powder may easily deteriorate a toner due to its high specific gravity, while ferrite, magnetite and maghemite are excellent in stability.

Specific examples of the magnetic particle include iron oxides such as magnetite, γ-iron oxide, Mn—Zn-based ferrite, Ni—Zn-based ferrite, Mn—Mg-based ferrite, Li-based ferrite, or Cu—Zn-based ferrite. Among these, magnetite is more preferably, in view of costs.

The particle diameter of the magnetic particle is preferably from 0.01 μm to 1 μm, more preferably from 0.05 μm to 0.7 μm, and even more preferably from 0.1 μm to 0.6 p.m. When the particle diameter of the magnetic particle is 0.01 μm or more, reduction in the magnetic force may be suppressed or a core material having uniform particle diameters may be obtained. When the particle diameter of the magnetic particle is 1 μm or less, a homogeneous core material may be obtained.

The content of the magnetic particle in the magnetic core material is preferably from 30% by weight to 95% by weight, more preferably from 45% by weight to 90% by weight, and even more preferably from 60% by weight to 90% by weight. When the content of the magnetic particle in the magnetic core material is 30% by weight or more, a constraining force may be obtained due to a sufficient magnetic force in each carrier, whereby scattering of the toner may be suppressed. When the content of the magnetic particle in the magnetic core material is 95% by weight or less, hardening and splitting of the magnetic brush may be suppressed, a load to a toner may be reduced, and a dense image may be obtained.

In the present exemplary embodiment, examples of the binder resin constituting the core material having magnetic particles dispersed therein include a cross-linked styrene resin, an acryl resin, a styrene-acryl copolymer resin, and a phenol resin Among these, a phenol resin is preferable.

In the present exemplary embodiment, the core material having magnetic particles dispersed therein may further contain other components according to the purposes.

Examples of the other components include a charge control agent and fluorine-containing particles.

In the present exemplary embodiment, a core material having magnetic particles dispersed therein, which contains magnetic particles and a binder resin, is preferably used as the magnetic core material. When the carrier has such a constitution, the specific gravity of the carrier is decreased and the load to the toner by the carrier is decreased, thereby the reproducibility of the image density may be maintained for a long time period.

The electrophotographic carrier according to the present exemplary embodiment has a resin layer which covers the magnetic core material. The resin layer contains the resistance control agent and the polymer including a repeating unit derived from an alicyclic group-containing methacrylic ester.

The polymer including the repeating unit derived from an alicyclic group-containing methacrylic ester is a polymer obtained using an alicyclic group-containing methacrylic ester as a monomer component. Specific examples of the alicyclic group-containing methacrylic ester include cyclohexyl methacrylate, cyclodecyl methacrylate, adamantyl methacrylate, cyclopropyl methacrylate, cyclobutyl methacrylate, cyclopentyl methacrylate, cycloheptyl methacrylate, cyclooctyl methacrylate, cyclononyl methacrylate, isobornyl methacrylate, cyclonorbornyl methacrylate, and cyclobornyl methacrylate. Among these, cyclohexyl methacrylate and cyclodecyl methacrylate are preferable, and cyclohexyl methacrylate is more preferable. As the alicyclic group, a cyclohexyl group is preferable in view of the hydrophobicity of the polymer and the strength of the resin layer.

The polymer including the repeating unit derived from an alicyclic group-containing methacrylic ester may be a copolymer further containing a repeating unit derived from a chain group-containing methacrylic ester. Here, the "chain group" means a group which does not include an alicyclic structure in the main chain thereof but has a chain structure in which atoms constituting the main chain are linearly arranged. This "chain group" may have a branched structure. Specific examples of the methacrylic ester having a chain group include methyl methacrylate, ethyl methacrylate, n-butyl methacrylate, isobutyl methacrylate, and tertiary butyl methacrylate. Among these, methyl methacrylate is preferable.

When the copolymer containing a repeating unit derived from a chain group-containing methacrylic ester is used in the resin layer, adhesiveness of the resin layer to the magnetic core material may be improved, and the resin layer may be hardened.

When the polymer including the repeating unit derived from an alicyclic group-containing methacrylic ester is a copolymer, the ratio by weight of the repeating unit derived from a chain group-containing methacrylic ester to the repeating unit derived from an alicyclic group-containing methacrylic ester (the repeating unit derived from a chain group-containing methacrylic ester/the repeating unit derived from an alicyclic group-containing methacrylic ester) is preferably from 1/99 to 20/80 (or from about 1/99 to about 20/80), and more preferably from 5/95 to 15/85 (or from about 5/95 to about 15/85). When the ratio by weight of the repeating unit derived from a chain group-containing methacrylic ester to the repeating unit derived from an alicyclic group-containing methacrylic ester is in the range of from about 1/99 to about 20/80, the adhesiveness of the resin layer to the magnetic core material may be improved.

The weight average molecular weight of the polymer including the repeating unit derived from an alicyclic group-containing methacrylic ester is preferably from $4.0\times10^4$ to $3.0\times10^5$ (or from about $4.0\times10^4$ to about $3.0\times10^5$), and more preferably from $5.0\times10^4$ to $2.0\times10^5$ (or from about $5.0\times10^4$ to about $2.0\times10^5$). When the weight average molecular weight of the polymer including the repeating unit derived from an alicyclic group-containing methacrylic ester is in the range of from $4.0\times10^4$ to $3.0\times10^5$, the dispersibility of the dispersed materials such as a resistance control agent, contained in the resin layer, may be improved. As a result, the reproducibility of the image density in a high temperature and high humidity condition may be improved. Here, the high temperature and high humidity condition indicates a condition of a temperature of 30° C. and a relative humidity of 80%.

The weight molecular weight is measured by a Gel Permeation Chromatography (GPC) method. The molecular weight is measured by a GPC method, using GPC/HLC-8120 (trade name, manufactured by TOSOH CORPORATION) as a measurement device, TSKge1 SuperHM-M (15 cm) (trade name, manufactured by TOSOH CORPORATION) as columns and THF as a solvent. The weight average molecular weight is determined based on the measurement results using a molecular weight calibration curve obtained from a monodisperse polystyrene standard sample.

The resin layer coating the magnetic core material contains a resistance control agent. Examples of the resistance control agent include metal particles such as gold, silver, or copper, carbon black particles, semiconductive oxide particles such as titanium oxide or zinc oxide, and particles in which the surface of titanium oxide, zinc oxide, barium sulfate, aluminum borate, potassium titanate, or the like is covered with tin oxide, carbon black, metals, or the like. These resistance control agents may be used singly or in combination of two or more kinds thereof. Among these, carbon black particles are preferable from the viewpoint of good preparation stability, cost, conductivity, or the like. The kind of the carbon black is not particularly limited, but carbon black having a DBP oil-absorbing amount of from about 50 ml/100 g to 250 ml/100 g is preferable in view of its excellent preparation stability.

A method for forming a resin layer that covers the magnetic core material is not particularly limited, but examples thereof include a method using a coating layer forming liquid which contains a resistance control agent and a polymer including a repeating unit derived from an alicyclic group-containing methacrylic ester in a solvent.

Specifically, examples of the method include an immersion method in which a magnetic core material is immersed in a coating layer forming liquid, a spraying method in which a coating layer forming liquid is sprayed onto the surface of a magnetic core material, and a kneader application method in which a magnetic core material is mixed with the coating layer forming liquid while the magnetic core material is floated by a fluidizing air, and the solvent is removed. Among these, a kneader application method is preferable in the present exemplary embodiment.

The solvent used in the coating layer forming liquid is not particularly limited as long as it dissolves the polymer (coating resin) including a repeating unit derived from an alicyclic group-containing methacrylic ester, and can be selected from known solvents. Examples of the solvent include aromatic hydrocarbons such as toluene or xylene; ketones such as acetone or methyl ethyl ketone; and ethers such as tetrahydrofuran or dioxane.

The volume average particle diameter of the electrophotographic carrier according to the present exemplary embodiment is preferably from 30 μm to 90 μm (or from about 30 μm to about 90 μm), and more preferably from 40 μm to 80 μm (or from about 40 μm to about 80 μm). When the volume average particle diameter is 30 μm or larger the adhesion of the carrier onto the photoconductor may be suppressed. When the volume average particle diameter is 90 μm or smaller, the image quality may be improved.

The thickness of the resin layer of the electrophotographic carrier according to the present exemplary embodiment is preferably from 0.3 μm to 10 μm (or from about 0.3 μm to about 10 μm), and more preferably from 0.5 μm to 5 μm (or from about 0.5 μm to about 5

Examples of a method of preparing the resin layer that contains the monomer as a base material of the repeating unit in the polymer in an amount of from about 0.5% by weight to about 3.0% by weight include the following methods.

Examples of the method include a method in which the condition is controlled at a time of resin polymerization such that the monomer remains, a method in which the resin is purified such that the monomer is reduced, and a method in which the monomer is added to the resin after polymerization.

Electrophotographic Developer

The electrophotographic developer according to the present exemplary embodiment consists of a 2-component developer including the electrophotographic carrier according to the present exemplary embodiment and a toner.

Hereinafter, the toner used in the electrophotographic developer according to the present exemplary embodiment is described.

Examples of the toner used in the present exemplary embodiment include known binder resins and various colorants. In the toner used in the present exemplary embodiment, the binder resin thereof is preferably a polyester resin, and more preferably a polyester resin containing an alkylene oxide adduct of bisphenol A as an alcoholic component from the viewpoint of excellent anti-filming property to a carrier. The polyester resin may be used singly or, if necessary, in combination with a resin such as styrene acryl, polyether polyol or urethane. The polyester resin may further include a crystalline polyester resin.

In the present exemplary embodiment, examples of the binder resin in the toner further include a polyolefin resin, a copolymer of styrene and an acrylic acid or a methacrylic acid, polyvinyl chloride, a phenol resin, an acrylic resin, a methacrylic resin, a polyvinyl acetate, a silicone resin, a modified polyester resin, a polyurethane, a polyamide resin, a furan resin, an epoxy resin, a xylene resin, a polyvinyl butyral, a terpene resin, a coumarone-indene resin, a petroleum-based resin, and a polyether-polyol resin. These resins may be used singly or in combination of two or more kinds thereof.

Examples of the colorant in the toner used in the present exemplary embodiment include, as a cyan colorant, cyan pigments such as C. I. Pigment Blue 1, 2, 3, 4, 5, 6, 7, 10, 11, 12, 13, 14, 15, 15:1, 15:2, 15:3, 15:4, 15:6, 16, 17, 23, 60, 65, 73, 83, or 180, C. I. Vat Cyan 1, 3, or 20, Iron Blue, Cobalt Blue, Alkali Blue Lake, Phthalocyanine Blue, Non-metal Phthalocyanine Blue, partially chlorinated Phthalocyanine Blue, Fast Sky Blue, Indanthrene Blue BC, and cyan pigments such as C. I. Solvent Cyan 79 or 162.

Examples of the magenta colorant include magenta pigments such as C. I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 163, 184, 202, 206, 207 or 209, or Pigment Violet 19; magenta pigments such as C. I. Solvent Red 1, 3, 8, 23, 24, 25, 27, 30, 49, 81, 82, 83, 84, 100, 109, or 121, C. I. Disperse Red 9, or C. I. Basic Red 1, 2, 9, 12, 13, 14, 15, 17, 18, 22, 23, 24, 27, 29, 32, 34, 35, 36, 37, 38, 39, or 40; Colcothar, Cadmium Red, Red Lead, mercury sulfide, cadmium, Permanent Red 4R, Lithol Red, Pyrazolone Red, Watchung Red, calcium salt, Lake Red D, Brilliant Carmine 6B, Eosin Lake, Rhodamine Lake B, Alizarin Lake, and Brilliant Carmine 3B.

Examples of the yellow colorant include yellow pigments such as C. I. Pigment Yellow 2, 3, 15, 16, 17, 97, 180, 185, or 139.

Examples of the colorant for a black toner include carbon black, active carbon, titanium black, magnetic powders, and Mn-containing nonmagnetic powders.

Further, the toner used in the present exemplary embodiment may preferably include a charge control agent. Examples thereof include nigrosine, a quaternary ammonium salt, an organic metal complex and a chelate complex. Further, as an external additive, silicon dioxide, titanium oxide, barium titanate, fluorine particles, acryl particles, or the like may be used singly or in combination of one another. Examples of the silica include commercially available products such as TG820 (trade name, manufactured by Cabot Corporation) or HVK2150 (trade name, manufactured by Clariant K. K.).

The toner used in the present exemplary embodiment preferably contains a releasing agent, and examples of the releasing agent include an ester wax, a polyethylene, a polypropylene, a copolymerization product of a polyethylene and a polypropylene, a polyglycerin wax, a microcrystalline wax, a paraffin wax, a carnauba wax, a sasol wax, a montanic ester wax, a deoxidized carnauba wax; unsaturated fatty acids such as palmitic acid, stearic acid, montanic acid, brassidic acid, eleostearic acid or parinaric acid; saturated alcohols such as stearin alcohol, aralkyl alcohol, behenyl alcohol, carnaubyl alcohol, ceryl alcohol, melissyl alcohol, or long-chain alkyl alcohols having a long chain alkyl group; polyhydric alcohols such as sorbitol; fatty acid amides such as linoleic acid amide, oleic acid amide, or lauric acid amide; saturated fatty acid bisamides such as methylene bisstearic acid amide, ethylene biscapric acid amide, ethylene bislauric acid amide, or hexamethylene bisstearic acid amide; unsaturated fatty acid amides such as ethylene bisoleic acid amide, hexamethylene bisoleic acid amide, N,N'-dioleyladipic acid amide, or N,N'-dioleylsebacic acid amide; aromatic bisamides such as m-xylenebisstearic acid amide or N,N'-distearylisophthalic acid amide; fatty acid metal salts (those generally called metal soaps) such as calcium stearate, calcium laurate, zinc stearate, or magnesium stearate; waxes obtained by grafting vinyl-based monomers such as styrene or an acrylic acid onto an aliphatic hydrocarbon type wax; partially esterified products of a fatty acid such as behenic acid monoglyceride or a polyhydric alcohol; and methyl ester compounds having a hydroxyl group, obtained by hydrogenation of a vegetable oil or fat, or the like.

The method for preparing a toner is not particularly limited, but examples thereof include a milling method, a polymerizing method, and any known method for preparing a toner.

The mixing ratio (toner/carrier) (ratio by weight) of the toner to the carrier according to the present exemplary embodiment is preferably in the range of about 1/100 to 30/100, and more preferably in the range of 3/100 to 20/100.

Image Forming Device

Hereinafter, the image forming apparatus according to the present exemplary embodiment using the electrophotographic developer according to the present exemplary embodiment is described.

The image forming apparatus according to the present exemplary embodiment includes a latent image holding member; a developing unit that develops the electrostatic latent image formed on the surface of the latent image holding member as a toner using a developer; a transfer unit that transfers the toner image formed on the surface of the latent image holding member to a image receiving body; and a fixing unit that fixes the toner image transferred on the image receiving body, and wherein the electrophotographic developer according to the present exemplary embodiment is used as the developer. The image forming apparatus according to the present exemplary embodiment may include other unit such as a cleaning unit that removes a component remaining on the surface of the latent image holding member by contacting a cleaning member, if necessary.

Hereinafter, an example of the image forming apparatus of the present exemplary embodiment is described, however the exemplary embodiment of the invention is not limited thereto. Only the main parts shown in the drawings are described, and the descriptions of other parts are omitted.

In the image forming apparatus, for example, a section including the developing unit may be a cartridge structure (process cartridge) which is detachable with respect to the main body of the image forming apparatus. The process cartridge includes at least a developer holding member, and the process cartridge according to the present exemplary embodiment, which accommodates the electrophotographic developer, is preferably used as a process cartridge.

FIG. 1 is a diagram illustrating the schematic configuration of a four-drum tandem-type full color image forming apparatus. The image forming apparatus shown in FIG. 1 includes electrophotographic first to fourth image forming units 10Y, 10M, 10C, and 10K (image forming unit) that output images for yellow (Y), magenta (M), cyan (C), and black (K) on the basis of image data subjected to color separation, respectively. The image forming units (hereinafter, simply referred to as "unit") 10Y, 10M, 10C, and 10K are arranged in a horizontal direction at predetermined intervals. The units 10Y, 10M, 10C, and 10K may be a process cartridge that is detachably mounted on the main body of the image forming apparatus.

On the upper side (in terms of the direction of the drawing) of the units 10Y, 10M, 10C, and 10K, an intermediate transfer belt 20 as an intermediate transfer member extends over the units. The intermediate transfer belt 20 is wound around a driving roller 22 and a support roller 24, which are arranged apart from each other in the horizontal direction of the drawing, and the support roller 24 comes into contact with the inner surface of the intermediate transfer belt 20. The intermediate transfer belt 20 travels in a direction from the first unit 10Y toward the fourth unit 10K. The support roller 24 is urged by a spring or the like (not shown) in a direction distant from the driving roller 22, such that predetermined tension is applied to the intermediate transfer belt 20 wound around both rollers. Furthermore, an intermediate transfer member cleaning device 30 is provided to face the driving roller 22 at a side of the image holding member of the intermediate transfer belt 20.

Developing devices (developing units) 4Y, 4M, 4C, 4K corresponding to the units 10Y, 10M, 10C, and 10K are supplied with toners of four colors of yellow, magenta, cyan, and black, which are contained in toner cartridges 8Y, 8M, 8C, and 8K, respectively.

Since each of the first to fourth units 10Y, 10M, 10C, and 10K have the similar configuration, a description will be given for the first unit 10Y that is provided on an upstream side in the travel direction of the intermediate transfer belt to form a yellow image. The same parts as those of the first unit 10Y are represented by the same reference numerals but having different labels magenta (M), cyan (C), and black (K), instead of yellow (Y), and the descriptions of the second to fourth units 10M, 10C, and 10K are omitted.

The first unit 10Y has a photoreceptor 1Y that functions as the image holding member. Around the photoreceptor 1Y are sequentially arranged a charging roller 2Y that charges the surface of the photoreceptor 1Y at a predetermined potential; an exposure device 3 that exposes the charged surface to a laser beam 3Y on the basis of an image signal subjected to color separation, thereby form an electrostatic image; a developing device (developing unit) 4Y that supplies a charged toner to the electrostatic image and develops the electrostatic image; a primary transfer roller 5Y (primary transfer unit) that transfers the developed toner image to the intermediate transfer belt 20; and a photoreceptor cleaning device (cleaning unit) 6Y that removes the toner remaining on the surface of the photoreceptor 1Y after primary transfer.

The primary transfer roller 5Y is disposed inside the intermediate transfer belt 20, and is provided to face the photoreceptor 1Y. In addition, each of the primary transfer rollers 5Y, 5M, 5C, and 5K is connected to a primary bias power source (not shown) and is applied with a primary transfer bias therefrom. The bias power source changes the transfer bias to be applied to the corresponding primary transfer roller under the control of a control unit (not shown).

Hereinafter, the operation of the first unit 10Y to form the yellow image is described. First, before the operation, the charging roller 2Y charges the surface of the photoreceptor 1Y at a potential of from about −600 V to about −800 V.

The photoreceptor 1Y is formed by forming a photosensitive layer on a conductive base substance (volume resistivity at 20° C. is 1×10-6 Ωcm or less). The photosensitive layer usually has high resistance (resistance corresponding to general resins), however, when the laser beam 3Y is irradiated, resistivity of a portion irradiated with the laser beam varies. The laser beam 3Y is output to the charged surface of the photoreceptor 1Y through the exposure device 3 according to image data for yellow from the control unit (not shown). The laser beam 3Y is irradiated onto the photosensitive layer on the surface of the photoreceptor 1Y, and accordingly, an electrostatic image having a yellow print pattern is formed on the surface of the photoreceptor 1Y.

The electrostatic image is an image that is formed on the surface of the photoreceptor 1Y by charging. Specifically, the electrostatic image is a so-called negative latent image that is formed as follows: the resistivity of an irradiated portion of the photosensitive layer is decreased by the laser beam 3Y, a charge on the surface of the photoreceptor 1Y flows while a charge in a portion not irradiated with the laser beam 3Y remains.

The electrostatic image formed on the photoreceptor 1Y in this manner is rotated to a predetermined development position as the photoreceptor 1Y travels. Then, at that development position, the electrostatic image on the photoreceptor 1Y becomes a visual image (toner image) by the developing device 4Y.

In the developing device 4Y, an electrostatic charge image developer containing at least a yellow toner and a carrier is contained. The yellow toner is stirred in the developing device 4Y and frictionally charged, and is held on a developer roller (developer holding member) with a charge having the same polarity (negative) as the charge on the photoreceptor 1Y. Then, when the surface of the photoreceptor 1Y passes through the developing device 4Y, the yellow toner is electrostatically adhered to a neutralized latent image portion on the surface of the photoreceptor 1Y, and the latent image is developed by the yellow toner. The photoreceptor 1Y on which a yellow toner image is formed continuously drives at a predetermined speed, and the toner image developed on the photoreceptor 1Y is transferred back to the predetermined primary transfer position.

When the yellow toner image on the photoreceptor 1Y is transferred to the primary transfer position, a predetermined primary transfer bias is applied to the primary transfer roller 5Y. Then, an electrostatic force from the photoreceptor 1Y toward the primary transfer roller 5Y acts on the toner image, and the toner image on the photoreceptor 1Y is transferred to the intermediate transfer belt 20. In this process, the applied transfer bias has a positive (+) polarity opposite to the polarity (−) of the toner. For example, the transfer bias of the first unit 10Y is controlled at approximately +10 μA by the control unit (not shown).

Meanwhile, the toner that remains on the photoreceptor 1Y is removed by the cleaning device 6Y and collected.

The primary transfer bias that is applied to the primary transfer rollers 5M, 5C, and 5K of the second units 10M, 10C, and 10K is controlled in the same manner as in the first unit.

In this manner, the intermediate transfer belt 20, to which the yellow toner image is transferred by the first unit 10Y, sequentially passes through the second to fourth units 10M, 10C, and 10K, such that the toner images for the individual colors are superposed and multiple transferred.

The intermediate transfer belt 20, to which the toner images for four colors are multiple transferred through the first to fourth units reaches a secondary transfer section. The secondary transfer section includes the intermediate transfer belt 20, the support roller 24 that comes into contact with the inner surface of the intermediate transfer belt 20, and a secondary transfer roller (secondary transfer unit) 26 that is arranged at a side of the image holding surface of the intermediate transfer belt 20. A recording paper (image receiving member) P is supplied to a gap between the secondary transfer roller 26 and the intermediate transfer belt 20 through a paper feed mechanism at a predetermined timing, and a predetermined secondary transfer bias is applied to the support roller 24. In this process, the applied transfer bias has a negative (−) polarity identical to the polarity (−) of the toner. An electrostatic force from the intermediate transfer belt 20 toward the recording paper P acts on the toner image, and the toner image on the intermediate transfer belt 20 is transferred to the recording paper P. The secondary transfer bias is determined depending on resistance detected by a resistance detection unit (not shown) of the second transfer section, and the voltage of the secondary transfer bias is controlled.

Subsequently, the recording paper P is forwarded to the fixing device (fixing unit) 28, the toner image is heated, and the color-superposed toner image is fused and fixed on the recording paper P. The recording paper P, on which a color image is fixed, is sent toward a discharge section, and then the color image forming operation is completed.

In the above-described image forming apparatus, the toner image is transferred to the recording paper P through the intermediate transfer belt 20. However, the exemplary embodiment of the invention is not limited thereto. For example, the toner image may be directly transferred from the photoreceptor to the recording paper.

Process Cartridge

Figure 2:
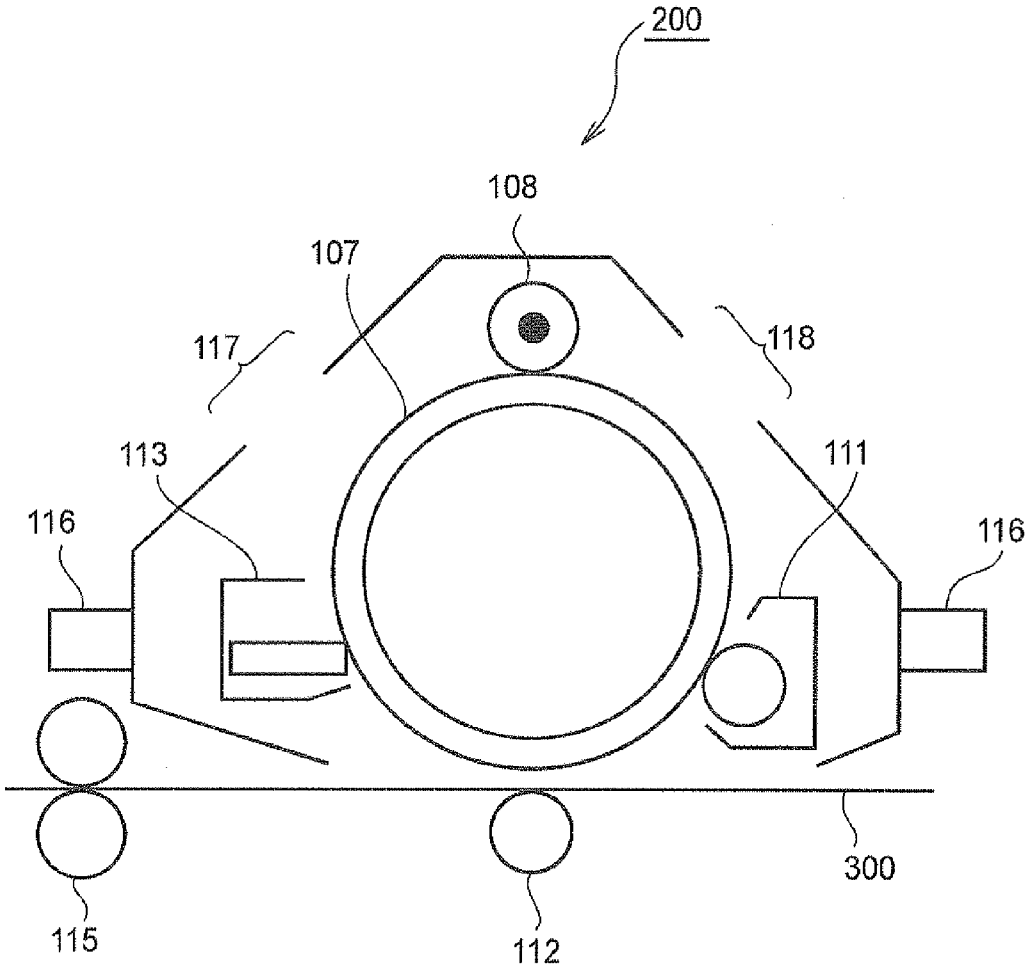
FIG. 2 is a schematic configuration diagram showing an example of a process cartridge according to the present exemplary embodiment.

FIG. 2 is a diagram showing the schematic configuration of a preferable example of a process cartridge that contains the developer of the present exemplary embodiment for developing an electrostatic charge image. A process cartridge 200 assembles a charging device (charging roller) 108, a developing device 111, a photoreceptor cleaning device 113, an opening 118 for exposure, and an opening 117 for neutralization exposure by using a mounting rail 116 to integrate, together with the photoreceptor 107. Here, reference numeral 300 indicates a recording medium.

The process cartridge 200 is detachable with respect to the main body of the image forming apparatus including a transfer device 112, a fixing device 115, and other components (not shown). The process cartridge 200 constitutes the image forming apparatus together with the main body of the image forming apparatus.

The process cartridge shown in FIG. 2 includes the photoreceptor 107, the charging device 108, the developing device 111, the cleaning device 113, the opening 118 for exposure, and the opening 117 for neutralization exposure. These devices may be select and used in combination. The process cartridge of the exemplary embodiment of the invention includes the developing device 111, and at least one of the photoreceptor 107, the charging device 108, the cleaning device (cleaning unit) 113, the opening 118 for exposure, and the opening 117 for neutralization exposure.

Next, a toner cartridge according to an exemplary embodiment of the invention is described. The toner cartridge of the present exemplary embodiment is preferably a toner cartridge that is detachably mounted on the image forming apparatus, and contains at least a toner to be supplied to a developing unit in the image forming apparatus. The toner cartridge of the present exemplary embodiment may contain at least a toner, or may contain a developer depending on the configuration of the image forming apparatus.

The image forming apparatus shown in FIG. 1 has the configuration on which the toner cartridges 8Y, 8M, 8C, and 8K are detachably mounted, and the developing devices 4Y, 4M, 4C, and 4K are connected to the corresponding toner cartridges through toner supply lines (not shown). When the toner contained in the toner cartridges is used up, the toner cartridges can be replaced.

EXAMPLES

Hereinafter, the present exemplary embodiment is described in detail with reference to Examples, but the present exemplary embodiment is not limited to these examples. Further, the "part" as used below is based on the weight unless otherwise specified.

Preparation of Magnetic Core Material 70 parts of $Fe_2O_3$, 22.5 parts of $MnO_2$, and 6.5 parts of $Mg(OH)_2$ are mixed, blended and milled for 30 hours in a wet ball mill, granulated and dried by a spray drier, and then subjected to tentative calcination (tentative calcination treatment 1) at 850° C. for 7 hours using a rotary kiln. The calcined product 1 the thus obtained is milled for 2 hours in a wet ball mill to give a volume average particle diameter of 2.1 then granulated and dried by a spray drier, and thereafter, subjected to tentative calcination (tentative calcination treatment 2) at 910° C. for 6 hours using a rotary kiln. The calcined product 2 thus obtained is milled for 4.8 hours in a wet ball mill to give a volume average particle diameter of 5.5 μm, then granulated and dried by a spray drier, and thereafter, subjected to main calcination at 950° C. for 16 hours using an electric furnace. Crushing and classification processes are carried out to prepare a magnetic core material having a volume average particle diameter of 36.0 μm.

Preparation of Coating Layer Forming Liquids

Preparation of Coating Layer Forming Liquid 1

| | |
|---|---|
| Cyclohexyl methacrylate | 1,000 parts |
| Benzene | 1,000 parts |
| Azobisisobutyronitrile | 20 parts |

The materials as above are heated to 60° C., shaken for 8 hours, and polymerized. The reaction products are dissolved in methyl ethyl ketone and precipitated in a 7-fold amount of hexane to obtain a resin A. The weight average molecular weight of the obtained resin A and the amount of the remaining monomers are 120,000 and 0.1% by weight, respectively.

| | |
|---|---|
| Resin A | 200 parts |
| Toluene | 800 parts |
| Cyclohexyl methacrylate | 2.53 parts |
| Carbon black R330 (Cabot) | 25 parts |

The components as above are stirred with glass beads (φ1 mm, 400 parts) using a sand mill (manufactured by Kansai Paint Co., Ltd.) at 1,200 rpm for 30 min, and the glass beads are then removed to give a coating layer forming liquid 1.

Preparation of Coating Layer Forming Liquid 2

| | |
|---|---|
| Cyclodecyl methacrylate | 1,000 parts |
| Benzene | 1,000 parts |
| Azobisisobutyronitrile | 20 parts |

The materials as above are heated to 60° C., shaken for 10 hours, and polymerized. The reaction products are dissolved in methyl ethyl ketone and precipitated in a 7-fold amount of hexane to obtain a resin B. The weight average molecular weight of the obtained resin B and the amount of the remaining monomers are 140,000 and 0.1% by weight, respectively.

| | |
|---|---|
| Resin B | 200 parts |
| Toluene | 800 parts |
| Cyclodecyl methacrylate | 2.53 parts |
| Carbon black R330 (Cabot) | 25 parts |

The components as above are stirred with glass beads 1 mm, 400 parts) using a sand mill (manufactured by Kansai Paint Co., Ltd.) at 1,200 rpm for 30 min, and the glass beads are then removed to give a coating layer forming liquid 2.

Preparation of Coating Layer Forming Liquid 3

| | |
|---|---|
| Resin A | 200 parts |
| Toluene | 800 parts |
| Cyclohexyl methacrylate | 0.93 part |
| Carbon black R330 (Cabot) | 25 parts |

The components as above are stirred with glass beads (ϕ1 mm, 400 parts) using a sand mill manufactured by Kansai Paint Co., Ltd.) at 1,200 rpm for 30 min, and the glass beads are then removed to give a coating layer forming liquid 3.

Preparation of Coating Layer Forming Liquid 4

| | |
|---|---|
| Resin A | 200 parts |
| Toluene | 800 parts |
| Cyclohexyl methacrylate | 4.39 parts |
| Carbon black R330 (Cabot) | 25 parts |

The components as above are stirred with glass beads (ϕ1 mm, 400 parts) using a sand mill (manufactured by Kansai Paint Co., Ltd.) at 1,200 rpm for 30 min, and the glass beads are then removed to give a coating layer forming liquid 4.

Preparation of Coating Layer Forming Liquid 5

| | |
|---|---|
| Resin A | 200 parts |
| Toluene | 800 parts |
| Cyclohexyl methacrylate | 6.75 parts |
| Carbon black R330 (Cabot) | 25 parts |

The components as above are stirred with glass beads (ϕ1 mm, 400 parts) using a sand mill (manufactured by Kansai Paint Co., Ltd.) at 1,200 rpm for 30 min, and the glass beads are then removed to give a coating layer forming liquid 5.

Preparation of Coating Layer Forming Liquid 6

| | |
|---|---|
| Cyclohexyl methacrylate | 950 parts |
| Methyl methacrylate | 50 parts |
| Benzene | 1,000 parts |
| Azobisisobutyronitrile | 20 parts |

The materials as above are heated to 60° C., shaken for 12 hours, and polymerized. The reaction products are dissolved in methyl ethyl ketone and precipitated in a 7-fold amount of hexane to obtain a resin C. The weight average molecular weight of the obtained resin C and the amount of the remaining monomers are 150,000 and 0.1% by weight, respectively.

| | |
|---|---|
| Resin C | 200 parts |
| Toluene | 800 parts |
| Cyclohexyl methacrylate | 2.53 parts |
| Carbon black R330 (Cabot) | 25 parts |

The components as above are stirred with glass beads (ϕ1 mm, 400 parts) using a sand mill (manufactured by Kansai Paint Co., Ltd.) at 1,200 rpm for 30 min, and the glass beads are then removed to give a coating layer forming liquid 6.

Preparation of Coating Layer Forming Liquid 7

| | |
|---|---|
| Cyclohexyl methacrylate | 900 parts |
| Methyl methacrylate | 100 parts |
| Benzene | 1,000 parts |
| Azobisisobutyronitrile | 20 parts |

The materials as above are heated to 60° C., shaken for 10 hours and polymerized. The reaction products are dissolved in methyl ethyl ketone and precipitated in a 7-fold amount of hexane to obtain a resin D. The weight average molecular weight of the obtained resin D and the amount of the remaining monomers are 140,000 and 0.1% by weight, respectively.

| | |
|---|---|
| Resin D | 200 parts |
| Toluene | 800 parts |
| Cyclohexyl methacrylate | 2.53 parts |
| Carbon black R330 (Cabot) | 25 parts |

The components as above are stirred with glass beads (ϕ1 mm, 400 parts) using a sand mill (manufactured by Kansai Paint Co., Ltd.) at 1,200 rpm for 30 min, and the glass beads are then removed to give a coating layer forming liquid 7.

Preparation of Coating Layer Forming Liquid 8

| | |
|---|---|
| Cyclohexyl methacrylate | 800 parts |
| Methyl methacrylate | 200 parts |
| Benzene | 1,000 parts |
| Azobisisobutyronitrile | 20 parts |

The materials as above are heated to 60° C., shaken for 11 hours, and polymerized. The reaction products are dissolved in methyl ethyl ketone and precipitated in a 7-fold amount of hexane to obtain a resin E. The weight average molecular weight of the obtained resin E and the amount of the remaining monomers are 140,000 and 0.1% by weight, respectively.

| | |
|---|---|
| Resin E | 200 parts |
| Toluene | 800 parts |
| Cyclohexyl methacrylate | 2.53 parts |
| Carbon black R330 (Cabot) | 25 parts |

The components as above are stirred with glass beads (ϕ1 mm, 400 parts) using a sand mill (manufactured by Kansai Paint Co., Ltd.) at 1,200 rpm for 30 min, and the glass beads are then removed to give a coating layer forming liquid 8.

Preparation of Coating Layer Forming Liquid 9

| | |
|---|---|
| Cyclohexyl methacrylate | 1,000 parts |
| Benzene | 1,000 parts |
| Azobisisobutyronitrile | 20 parts |

The materials as above are heated to 58° C., shaken for 3.5 hours and polymerized. The reaction products are dissolved in methyl ethyl ketone and precipitated in a 7-fold amount of hexane to obtain a resin F. The weight average molecular weight of the obtained resin F and the amount of the remaining monomers are 40,000 and 0.1% by weight, respectively.

| | |
|---|---|
| Resin F | 200 parts |
| Toluene | 800 parts |
| Cyclohexyl methacrylate | 2.53 parts |
| Carbon black R330 (Cabot) | 25 parts |

The components as above are stirred with glass beads (ϕ1 mm, 400 parts) using a sand mill (manufactured by Kansai Paint Co., Ltd.) at 1,200 rpm for 30 min, and the glass beads are then removed to give a coating layer forming liquid 9.

Preparation of Coating Layer Forming Liquid 10

| | |
|---|---|
| Cyclohexyl methacrylate | 1,000 parts |
| Benzene | 1,000 parts |
| Azobisisobutyronitrile | 20 parts |

The materials as above are heated to 65° C., shaken for 9 hours, and polymerized. The reaction products are dissolved in methyl ethyl ketone and precipitated in a 7-fold amount of hexane to obtain a resin G. The weight average molecular weight of the obtained resin G and the amount of the remaining monomers are 300,000 and 0.1% by weight, respectively.

| | |
|---|---|
| Resin G | 200 parts |
| Toluene | 800 parts |
| Cyclohexyl methacrylate | 2.53 parts |
| Carbon black R330 (Cabot) | 25 parts |

The components as above are stirred with glass beads (ϕ1 mm, 400 parts) using a sand mill (manufactured by Kansai Paint Co., Ltd.) at 1,200 rpm for 30 min, and the glass beads are then removed to give a coating layer forming liquid 10.

Preparation of Coating Layer Forming Liquid 11

| | |
|---|---|
| Cyclohexyl methacrylate | 700 parts |
| Methyl methacrylate | 300 parts |
| Benzene | 1,000 parts |
| Azobisisobutyronitrile | 20 parts |

The materials as above are heated to 60° C., shaken for 11 hours, and polymerized. The reaction products are dissolved in methyl ethyl ketone and precipitated in a 7-fold amount of hexane to obtain a resin H. The weight average molecular weight of the obtained resin H and the amount of the remaining monomers are 140,000 and 0.1% by weight, respectively.

| | |
|---|---|
| Resin H | 200 parts |
| Toluene | 800 parts |
| Cyclohexyl methacrylate | 2.53 parts |
| Carbon black R330 (Cabot) | 25 parts |

The components as above are stirred with glass beads (ϕ 1 mm, 400 parts) using a sand mill (manufactured by Kansai Paint Co., Ltd.) at 1,200 rpm for 30 min, and the glass beads are then removed to give a coating layer forming liquid 11.

Preparation of Coating Layer Forming Liquid 12

| | |
|---|---|
| Cyclohexyl methacrylate | 1,000 parts |
| Benzene | 1,000 parts |
| Azobisisobutyronitrile | 20 parts |

The materials as above are heated to 68° C., shaken for 9 hours and polymerized. The reaction products are dissolved in methyl ethyl ketone and precipitated in a 7-fold amount of hexane to obtain a resin I. The weight average molecular weight of the obtained resin and the amount of the remaining monomers are 420,000 and 0.1% by weight, respectively.

| | |
|---|---|
| Resin I | 200 parts |
| Toluene | 800 parts |
| Cyclohexyl methacrylate | 2.53 parts |
| Carbon black R330 (Cabot) | 25 parts |

The components as above are stirred with glass beads (ϕ1 mm, 400 parts) using a sand mill (manufactured by Kansai Paint Co., Ltd.) at 1,200 rpm for 30 min, and the glass beads are then removed to give a coating layer forming liquid 12.

Preparation of Coating Layer Forming Liquid 13

| | |
|---|---|
| Cyclohexyl methacrylate | 1,000 parts |
| Benzene | 1,000 parts |
| Azobisisobutyronitrile | 20 parts |

The materials as above are heated to 57° C., shaken for 3 hours and polymerized. The reaction products are dissolved in methyl ethyl ketone and precipitated in a 7-fold amount of hexane to obtain a resin J. The weight average molecular weight of the obtained resin J and the amount of the remaining monomers are 33,000 and 0.1% by weight, respectively.

| | |
|---|---|
| Resin J | 200 parts |
| Toluene | 800 parts |
| Cyclohexyl methacrylate | 2.53 parts |
| Carbon black R330 (Cabot) | 25 parts |

The components as above are stirred with glass beads (4) 1 mm, 400 parts) using a sand mill (manufactured by Kansai Paint Co., Ltd.) at 1,200 rpm for 30 min, and the glass beads are then removed to give a coating layer forming liquid 13.

Preparation of Coating Layer Forming Liquid 14

| | |
|---|---|
| Resin A | 200 parts |
| Toluene | 800 parts |
| Cyclohexyl methacrylate | 0.03 part |
| Carbon black R330 (Cabot) | 25 parts |

The components as above are stirred with glass beads (ϕ1 mm, 400 parts) using a sand mill (manufactured by Kansai Paint Co., Ltd.) at 1,200 rpm for 30 min, and the glass beads are then removed to give a coating layer forming liquid 14.

Preparation of Coating Layer Forming Liquid 15

| | |
|---|---|
| Resin A | 200 parts |
| Toluene | 800 parts |
| Cyclohexyl methacrylate | 0.48 part |
| Carbon black R330 (Cabot) | 25 parts |

The components as above are stirred with glass beads (ϕ1 mm, 400 parts) using a sand mill (manufactured by Kansai Paint Co., Ltd.) at 1,200 rpm for 30 min, and the glass beads are then removed to give a coating layer forming liquid 15.

Preparation of Coating Layer Forming Liquid 16

| | |
|---|---|
| Resin A | 200 parts |
| Toluene | 800 parts |
| Cyclohexyl methacrylate | 9.17 parts |
| Carbon black R330 (Cabot) | 25 parts |

The components as above are stirred with glass beads (ϕ1 mm, 400 parts) using a sand mill (manufactured by Kansai Paint Co., Ltd.) at 1,200 rpm for 30 min, and the glass beads are then removed to give a coating layer forming liquid 16.

Preparation of Toners

Preparation of Amorphous Polyester Resin (A1) and Amorphous Resin Particle Dispersion Liquid (a1)

15 parts by mole of polyoxyethylene(2,0)-2,2-bis(4-hydroxyphenyl)propane, 85 parts by mole of polyoxypropylene (2,2)-2,2-bis(4-hydroxyphenyl)propane, 10 parts by mole of terephthalic acid, 67 parts by mole of fumaric acid, 3 parts by mole of n-dodecenylsuccinic acid, and 20 parts by mole of trimellitic acid, and 0.05 parts by mole of dibutyltin oxide with respect to these acid components (total moles of terephthalic acid, n-dodecenylsuccinic acid, trimellitic acid, and fumaric acid) are put into a 2-neck flask that has been dried by heating, and the mixture is warmed while maintaining it under an inert atmosphere with introduction of a nitrogen gas into a container, and then subjected to a copolycondensation reaction at 150° C. to 230° C. for 12 hours to 20 hours, and then slowly subjected to pressure reduction at 210° C. to 250° C., thereby synthesizing an amorphous polyester resin (A1). The weight average molecular weight (Mw) and the glass transition temperature (Tg) of this resin are 65,000 and 65° C., respectively.

3000 parts of the obtained amorphous polyester resin (A1), 10000 parts of ion exchange water, and 90 parts of sodium dodecylbenzenesulfonate as a surfactant are introduced into an emulsifying tank of a high temperature/high pressure emulsifier (trade name: CAVITRON CD1010, manufactured by EUROTEC LTD.; slit: 0.4 mm), and the mixture is then heated to 130° C. and dissolved. Thereafter, the mixture is dispersed at 110° C., a flow rate of 3 L/m, and 10,000 rpm for 30 min, and a cooling tank is passed therethrough to recover an amorphous resin particle dispersion using a high temperature/high pressure emulsifier (CAVITRON CD1010 slit 0.4 mm) and obtain an amorphous resin particle dispersion liquid (a1).

Preparation of Crystalline Polyester Resin (B1) and Crystalline Resin Particle Dispersion Liquid (b1)

45 Parts by mole of 1,9-nonanediol, 55 parts by mole of dodecanedicarboxylic acid, and 0.05 parts by mole of dibutyltin oxide as a catalyst are put into a 3-neck flask that has been dried by heating, the air in the container is made an inert atmosphere by a nitrogen gas by a pressure reduction operation, and the mixture is stirred by mechanic stirring at 180° C. for 2 hours. Thereafter, the mixture is slowly warmed to 230° C. under reduced pressure and stirred for 5 hours, and when the mixture became viscous, it is cooled in air, and the reaction is stopped to synthesize a crystalline polyester resin (B1). The weight average molecular weight (Mw) and the melting point (Tm) of this resin are 25,000 and 73° C., respectively.

Thereafter, a crystalline resin particle dispersion liquid (b1) is obtained using a high temperature/high pressure emulsifier (CAVITRON CD1010, slit: 0.4 min) under the same condition as for the preparation of the amorphous resin particle dispersion liquid (a1).

Preparation of Colorant Particle Dispersion Liquid (1)

| | |
|---|---|
| Cyan pigment (Pigment Blue 15:3, manufactured by Dainichseika Color & Chemicals Mfg. Co., Ltd.) (copper phthalocyanine): | 100 parts |
| Anion surfactant (Sodium lauryl sulfate, manufactured by Wako Pure Chemical Industries): | 15 parts |
| Ion exchange water: | 400 parts |

The components as above are mixed and dissolved, and colorant (cyan pigment) particles are dispersed using a high pressure counter collision type dispersing machine ULTIMAIZER HJP30006 (manufactured by Sugino Machine Ltd.) for 1 hour, thereby obtaining a colorant particle dispersion liquid (1). The volume average particle diameter of the colorant (cyan pigment) particle and the colorant particle concentration in the colorant particle dispersion liquid (1) are 0.15 μm and 20% by weight, respectively.

Preparation of Releasing Agent Particle Dispersion Liquid (1)

| | |
|---|---|
| Fatty acid amide wax (trade name: NEUTRON D, manufactured by Nippon Fine Chemical Co., Ltd.): | 100 parts |
| Anion surfactant (trade name: NEWREX R, manufactured by NOF Corporation,): | 2 parts |
| Ion exchange water: | 300 parts |

The components as above are heated to 95° C., dispersed using a homogenizer ULTRATRAX T50 (trade name, manufactured by IKA Japan Co.), and then subjected to a dispersion treatment using a pressure discharge type GAOLJN homogenizer (manufactured by GAOLIN), thereby obtaining a releasing agent particle dispersion liquid (1) (releasing agent concentration: 20% by weight) in which the releasing agent particles having a volume average particle diameter of 200 nm is dispersed.

Preparation of Toners

Preparation of Toner Mother Particle A

| | |
|---|---|
| Amorphous resin particle dispersion liquid (a1): | 280 parts |
| Crystalline resin particle dispersion liquid (b1): | 120 parts |
| Colorant particle dispersion liquid (1): | 50 parts |
| Releasing agent particle dispersion liquid (1): | 60 parts |
| Aluminum sulfate (manufactured by Wako Pure Chemical Industries): | 5 parts |
| Aqueous surfactant solution: | 10 parts |
| 0.3M aqueous acetic acid solution: | 50 parts |
| Ion exchange water: | 500 parts |

The components as above are put into a round-bottom stainless steel-made flask, dispersed using a homogenizer ULTRATRAX T50 (manufactured by IKA Japan Co.), then heated to 42° C. in an oil bath for heating, and kept for 30 minutes. Thereafter, the temperature of the oil bath for heating is elevated, and kept at 58° C. for 60 minutes, and when confirming that aggregated particles having an average particle diameter of about 5.2 μm is formed, 100 parts of an additional amorphous resin particle dispersion (a1) is added thereto, and then the mixture is further kept for 30 minutes.

Subsequently, a 1 N aqueous sodium hydroxide solution is slowly added thereto until pH reached 7.2, and then the mixture is heated to 83° C. while continuing stirring, and kept for 3 hours. Thereafter, the reaction product is filtered, washed with ion exchange water, and dried using a vacuum drier to obtain toner mother particles.

| | |
|---|---|
| Toner mother particles: | 100 parts |
| Rutile-type titanium oxide having a volume average particle diameter of 20 nm, hydrophobized by decyl silane: | 0.8 parts |
| Silicon oxide having a volume average particle diameter of 40 nm, treated with silicone oil: | 1.0 part |

The materials above are mixed using a Henschel mixer to obtain a toner.

Example 1

Preparation of Carrier 1

| | |
|---|---|
| Magnetic core material | 1,000 parts |
| Coating layer forming liquid 1 | 135 parts |

The components above are put into a kneader, mixed at an ambient temperature for 20 minutes, then heated to 70° C., dried under reduced pressure, and then collected to obtain a coated carrier. Further, the obtained coated carrier is sieved with a 75 μm mesh screen to remove crude powders, thereby obtaining a carrier 1.

Preparation of Developer 1

The carrier 1 and the obtained toners are put into a V blender at a ratio by weight of 92:8, and stirred for 20 minutes to prepare a developer 1.

Evaluation

The obtained developer 1 is charged into a developing device, APEOSPORT III C3300 (trade name, manufactured by Fuji Xerox. Co., Ltd.), and 10000 sheets of an image at an image density of 1% are output in an environment of 30° C./80% RH while keeping the toner concentration at 8%, and then 1 sheet of an image is output at an image density of 30%. Thereafter, one sheet each of the output images as described under the sections regarding a method for measuring a development amount and a method for evaluating gradation reproducibility described below is output. These images are referred to as the "early images". Thereafter, 9 sheets of an image are output at an image density of 30%, and then one sheet each of the output images as described under the sections regarding a method for measuring a development amount and a method for evaluating gradation reproducibility described below is output. These images are referred to as the "later images". The "early images" and the "later images" are evaluated in accordance with the following criteria by the following methods. The obtained results are shown in the following Table.

Method for Measuring Development Amount

An image having 2 solid images sized 2 cm×5 cm is output without fixing. The toner weight on the paper is measured before and after removal of the toner, and the difference is defined as the development amount. Evaluation is conducted in accordance with the following criteria.

Evaluation Criteria

A: The development amount is from 4.0 g/m$^2$ to 5.0 g/m$^2$.

B: The development amount is 3.75 g/m$^2$ or more and less than 4.0 g/m$^2$, or more than 5.0 g/m$^2$ and 5.25 g/m$^2$ or less.

C: The development amount is less than 3.75 g/m$^2$, or more than 5.25 g/m$^2$.

Method for Evaluating Gradation Reproducibility

Charts having image area ratios of 10% to 100% at 10% increments are output on respective patch sized 2 cm×2 cm, the density of each patch is measured using X-Rite and a correlation coefficient is determined based on a regression line of the image area ratio on the density.

Evaluation Criteria

A: The correlation coefficient is from 0.9 to 1.0.

B: The correlation coefficient is 0.8 or more and less than 0.9.

C: The correlation coefficient is less than 0.8.

Example 2

A carrier 2 is prepared in the same manner as in Example 1 except that the coating layer forming liquid 2 is used instead of the coating layer forming liquid 1. A developer 2 is prepared in the same manner as in Example 1 except that the carrier 2 is used instead of the carrier 1. Evaluation is conducted using the developer 2 in the same manner as in Example 1. The obtained results are shown in the Table.

Example 3

A carrier 3 is prepared in the same manner as in Example 1 except that the coating layer forming liquid 3 is used instead of the coating layer forming liquid 1. A developer 3 is prepared in the same manner as in Example 1 except that the carrier 3 is used instead of the carrier 1. Evaluation is conducted using the developer 3 in the same manner as in Example 1. The obtained results are shown in the Table.

Example 4

A carrier 4 is prepared in the same manner as in Example 1 except that the coating layer forming liquid 4 is used instead of the coating layer forming liquid 1. A developer 4 is prepared in the same manner as in Example 1 except that the carrier 4 is used instead of the carrier 1. Evaluation is conducted using the developer 4 in the same manner as in Example 1. The obtained results are shown in the Table.

Example 5

A carrier 5 is prepared in the same manner as in Example 1 except that the coating layer forming liquid 5 is used instead of the coating layer forming liquid 1. A developer 5 is prepared in the same manner as in Example 1 except that the carrier 5 is used instead of the carrier 1. Evaluation is conducted using the developer 5 in the same manner as in Example 1. The obtained results are shown in the Table.

Example 6

A carrier 6 is prepared in the same manner as in Example 1 except that the coating layer forming liquid 6 is used instead of the coating layer forming liquid 1. A developer 6 is prepared in the same manner as in Example 1 except that the carrier 6 is used instead of the carrier 1. Evaluation is conducted using the developer 6 in the same manner as in Example 1. The obtained results are shown in the Table.

Example 7

A carrier 7 is prepared in the same manner as in Example 1 except that the coating layer forming liquid 7 is used instead of the coating layer forming liquid 1. A developer 7 is prepared in the same manner as in Example 1 except that the carrier 7 is used instead of the carrier 1. Evaluation is conducted using the developer 7 in the same manner as in Example 1. The obtained results are shown in the Table.

Example 8

A carrier 8 is prepared in the same manner as in Example 1 except that the coating layer forming liquid 8 is used instead of the coating layer forming liquid 1. A developer 8 is prepared in the same manner as in Example 1 except that the carrier 8 is used instead of the carrier 1. Evaluation is conducted using the developer 8 in the same manner as in Example 1. The obtained results are shown in the Table.

Example 9

A carrier 9 is prepared in the same manner as in Example 1 except that the coating layer forming liquid 9 is used instead of the coating layer forming liquid 1. A developer 9 is prepared in the same manner as in Example 1 except that the carrier 9 is used instead of the carrier 1. Evaluation is conducted using the developer 9 in the same manner as in Example 1. The obtained results are shown in the Table.

Example 10

A carrier 10 is prepared in the same manner as in Example 1 except that the coating layer forming liquid 10 is used instead of the coating layer forming liquid 1. A developer 10 is prepared in the same manner as in Example 1 except that the carrier 10 is used instead of the carrier 1. Evaluation is conducted using the developer 10 in the same manner as in Example 1. The obtained results are shown in the Table.

Example 11

A carrier 11 is prepared in the same manner as in Example 1 except that the coating layer forming liquid 11 is used instead of the coating layer forming liquid 1. A developer 11 is prepared in the same manner as in Example 1 except that the carrier 11 is used instead of the carrier 1. Evaluation is conducted using the developer 11 in the same manner as in Example 1. The obtained results are shown in the Table.

Example 12

A carrier 12 is prepared in the same manner as in Example 1 except that the coating layer forming liquid 12 is used instead of the coating layer forming liquid 1. A developer 12 is prepared in the same manner as in Example 1 except that the carrier 12 is used instead of the carrier 1. Evaluation is conducted using the developer 12 in the same manner as in Example 1. The obtained results are shown in the Table.

Example 13

A carrier 13 is prepared in the same manner as in Example 1 except that the coating layer forming liquid 13 is used instead of the coating layer forming liquid 1. A developer 13 is prepared in the same manner as in Example 1 except that the carrier 13 is used instead of the carrier 1. Evaluation is conducted using the developer 13 in the same manner as in Example 1. The obtained results are shown in the Table.

Comparative Example 1

A carrier 14 is prepared in the same manner as in Example 1 except that the coating layer forming liquid 14 is used instead of the coating layer forming liquid 1. A developer 14 is prepared in the same manner as in Example 1 except that the carrier 14 is used instead of the carrier 1. Evaluation is conducted using the developer 14 in the same manner as in Example 1. The obtained results are shown in the Table.

Comparative Example 2

A carrier 15 is prepared in the same manner as in Example 1 except that the coating layer forming liquid 15 is used instead of the coating layer forming liquid 1. A developer 15 is prepared in the same manner as in Example 1 except that the carrier 15 is used instead of the carrier 1. Evaluation is conducted using the developer 15 in the same manner as in Example 1. The obtained results are shown in the Table.

Comparative Example 3

A carrier 16 is prepared in the same manner as in Example 1 except that the coating layer forming liquid 16 is used instead of the coating layer forming liquid 1. A developer 16 is prepared in the same manner as in Example 1 except that the carrier 16 is used instead of the carrier 1. Evaluation is conducted using the developer 16 in the same manner as in Example 1. The obtained results are shown in the Table.

TABLE 1

| | | | Early images | | Later images | |
|---|---|---|---|---|---|---|
| | Amount of monomers (%) | Molecular weight (Mw) | Development amount | Gradation reproducibility | Development amount | Gradation reproducibility |
| Ex. 1 | 1.2 | 120,000 | A | A | A | A |
| Ex. 2 | 1.2 | 140,000 | A | A | A | A |
| Ex. 3 | 0.5 | 120,000 | A | B | A | A |
| Ex. 4 | 2 | 120,000 | A | A | A | A |
| Ex. 5 | 3 | 120,000 | A | B | A | A |
| Ex. 6 | 1.2 | 150,000 | B | A | A | A |
| Ex. 7 | 1.2 | 140,000 | B | B | A | A |
| Ex. 8 | 1.2 | 140,000 | B | B | B | A |
| Ex. 9 | 1.2 | 40,000 | B | A | B | A |
| Ex. 10 | 1.2 | 300,000 | A | B | A | B |

TABLE 1-continued

| | Amount of monomers (%) | Molecular weight (Mw) | Early images | | Later images | |
|---|---|---|---|---|---|---|
| | | | Development amount | Gradation reproducibility | Development amount | Gradation reproducibility |
| Ex. 11 | 1.2 | 140,000 | B | B | B | B |
| Ex. 12 | 1.2 | 420,000 | B | B | B | B |
| Ex. 13 | 1.2 | 33,000 | B | A | B | B |
| Comp. Ex. 1 | 0.1 | 120,000 | C | C | C | C |
| Comp. Ex. 2 | 0.3 | 120,000 | C | C | B | B |
| Comp. Ex. 3 | 4 | 120,000 | C | C | C | B |

Ex.: Example;
Comp. Ex.: Comparative Example

The foregoing description of the exemplary embodiments of the present invention has been provided for the purposes of illustration and description. It is not limited to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrophotographic carrier comprising:
a magnetic core material; and
a resin layer that coats the magnetic core material,
the resin layer comprising a resistance control agent and a polymer including a repeating unit derived from an alicyclic group-containing methacrylic ester, and the resin layer comprising a monomer as a base material of the repeating unit in the polymer in an amount of from about 0.5% by weight to about 3.0% by weight relative to the total amount of the resin layer.

2. The electrophotographic carrier according to claim 1, wherein the polymer further comprises a repeating unit derived from a chain group-containing methacrylic ester.

3. The electrophotographic carrier according to claim 2, wherein a ratio by weight of the repeating unit derived from a chain group-containing methacrylic ester to the repeating unit derived from an alicyclic group-containing methacrylic ester (the repeating unit derived from a chain group-containing methacrylic ester/the repeating unit derived from an alicyclic group-containing methacrylic ester) is from about 1/99 to about 20/80.

4. The electrophotographic carrier according to claim 1, wherein a weight average molecular weight of the polymer is from about $4.0\times10^4$ to about $3.0\times10^5$.

5. The electrophotographic carrier according to claim 1, wherein a volume average particle diameter of the carrier is from about 30 μm to about 90 μm.

6. The electrophotographic carrier according to claim 1, wherein a thickness of the resin layer is from about 0.3 μm to about 10 μm.

7. The electrophotographic carrier according to claim 1, wherein the alicyclic group-containing methacrylic ester is cyclohexyl methacrylate.

8. The electrophotographic carrier according to claim 1, wherein the resistance control agent comprises carbon black.

9. An electrophotographic developer comprising:
the electrophotographic carrier according to claim 1; and
a toner.

10. The electrophotographic developer according to claim 9, wherein the toner comprises a polyester resin as a binder resin.

11. The electrophotographic developer according to claim 10, wherein the polyester resin further comprises a crystalline polyester resin.

12. The electrophotographic developer according to claim 9, wherein the toner comprises an amide wax as a releasing agent.

13. The electrophotographic developer according to claim 9, wherein the toner comprises silicon dioxide and titanium oxide as external additives.

14. A process cartridge including at least a developer holding member, wherein the process cartridge accommodates the electrophotographic developer according to claim 9.

15. An image forming apparatus comprising:
a latent image holding member;
a developing unit that develops an electrostatic latent image formed on the surface of the latent image holding member as a toner image using the electrophotographic developer according to claim 9;
a transfer unit that transfers the toner image formed on the surface of the latent image holding member to an image receiving body; and
a fixing unit that fixes the toner image that has been transferred to the image receiving body.

* * * * *